US008766875B2

(12) United States Patent
Williams et al.

(10) Patent No.: US 8,766,875 B2
(45) Date of Patent: Jul. 1, 2014

(54) LIGHTWEIGHT STIFFENER WITH INTEGRATED RF CAVITY-BACKED RADIATOR FOR FLEXIBLE RF EMITTERS

(75) Inventors: Robert Brett Williams, W. Hollywood, CA (US); Kyle W. Maxhimer, Hermosa Beach, CA (US); Larry L. Lai, Walnut, CA (US); Thomas Brennan, Marina Del Rey, CA (US); Clifton Quan, Arcadia, CA (US); Fangchou Yang, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 257 days.

(21) Appl. No.: 13/476,764

(22) Filed: May 21, 2012

(65) Prior Publication Data

US 2013/0307754 A1 Nov. 21, 2013

(51) Int. Cl.
*H01Q 15/14* (2006.01)
*H01Q 1/28* (2006.01)

(52) U.S. Cl.
CPC ..... *H01Q 15/144* (2013.01); *H01Q 1/28* (2013.01)
USPC ..... 343/912

(58) Field of Classification Search
CPC ..... H01Q 1/28; H01Q 15/144
USPC ..... 343/912
See application file for complete search history.

(56) References Cited

U.S. PATENT DOCUMENTS 3,964,071 A * 6/1976 Townes et al. ..... 343/840
4,030,103 A * 6/1977 Campbell ..... 343/915
4,255,752 A 3/1981 Noble et al.
4,625,214 A * 11/1986 Parekh ..... 343/756
5,421,376 A 6/1995 Sinha
5,515,067 A * 5/1996 Rits ..... 343/912
6,344,835 B1 * 2/2002 Allen et al. ..... 343/915
6,531,992 B1 * 3/2003 Ehrenberg et al. ..... 343/912
2004/0201543 A1 10/2004 Gottl et al.

FOREIGN PATENT DOCUMENTS

EP 0 884 797 A1 12/1998
WO WO 03/030301 A1 4/2003
WO WO 2008/045349 A1 4/2008

OTHER PUBLICATIONS

Written Opinion of the International Searching Authority for International Application No. PCT/US2013/033186, filed Mar. 20, 2013, Written Opinion of the International Searching Authority mailed Jul. 3, 2013 (6 pgs.)
International Search Report for International Application No. PCT/US2013/033186, filed Jul. 3, 2013, International Search Report dated Jun. 27, 2013 and mailed Jul. 3, 2013 (4 pgs.).

* cited by examiner

*Primary Examiner* — Hoang V Nguyen
(74) *Attorney, Agent, or Firm* — Christie, Parker & Hale, LLP

(57) ABSTRACT

An integrated stiffener and RF reflector (stiffener/reflector) (100) for a RF emitter which includes: a plurality of vertical ribs (102) constituting side walls of the stiffener/reflector; a plurality of horizontal ribs (104) formed in a width direction of the stiffener/reflector; a top cover (204) including metallization layer (308), the top cover being electrically coupled to a ground layer (312) of the RF emitter and configured in such a way to direct all of RF energy in an opposite direction to the top cover. Each of the vertical (102) and horizontal (104) ribs has a sandwich structure, which includes: a foam core layer (302) disposed on a layer of the RF emitter (314); a thin film layer (306) bonded to sides and top of the rib to form facesheets of the sandwich structure.

18 Claims, 4 Drawing Sheets

LIGHTWEIGHT STIFFENER WITH INTEGRATED RF CAVITY-BACKED RADIATOR FOR FLEXIBLE RF EMITTERS

STATEMENT REGARDING FEDERALLY SPONSORED RESEARCH

This invention disclosure is related to a government contract. The U.S. Government has certain rights to this invention.

FIELD OF THE INVENTION

The present invention relates to antennas and more specifically to a lightweight stiffener with integrated RF cavity-backed radiator for flexible RF emitters.

BACKGROUND

Reflectors are used to reflect radiant energy in the form of visible light, infra red light, radio frequency waves, and microwave frequency waves. Those reflectors have been applied in communication systems and radar systems for redirecting incident radiant energy via the relatively large area of the reflector. Some communication systems and radar systems are used in air or space borne applications. Accordingly, the weight of the reflector in such systems is an important factor. The greater the weight of such systems, the greater amount of fuel and force is required for the airship to lift off and stay in the air.

Electromagnetic wave reflectors are used in the design of antennas in the telecommunication and radar applications. A typical antenna is composed of a radio frequency source and a reflector with a certain shape, such as flat or parabolic. A source is placed at the focal point of the reflector and is designed to emit or receive electromagnetic radiation focalized by the reflector.

Accordingly, radar panels that have light weight, such as thin film panels, have been developed. However, because of the non-rigidity or flexibility of such light weight panels, they need to be structurally reinforced. Different structures for the reflector/panel have been developed. For example, machined metal structures or formed wire metal structures for stiffeners and reflectors have been developed. However, such structures are relatively heavy and add a substantial depth to the radar panel.

Moreover, the radar panel includes multiple radiating elements. Each radiating element is excited by corresponding transmit/receive (TR) module within the radar. The radiating element radiate RF energy in an omni-directional manner and therefore, consume more energy. In unidirectional applications, metal-based reflectors are used to reflect the radar radiations from one direction to another direction and thus increasing the radar power for a given power supply. However, such metal reflectors are heavy and take up a lot of space.

As a result, there is a need for a light weight and relatively rigid reflector that is relatively easy to manufacture.

SUMMARY

In some embodiments, the present invention is an integrated stiffener and RF reflector (stiffener/reflector) for an RF emitter which includes: a plurality of vertical ribs including metallization layer constituting side walls of the stiffener/reflector; a plurality of horizontal ribs foamed in a width direction of the stiffener/reflector; a top cover including metallization layer, the top cover and side walls being electrically coupled to a ground layer of the RF emitter and configured in such a way to direct all of RF energy in an opposite direction to the top cover. Each of the vertical ribs has a sandwich structure construction, which includes: a foam core layer sandwiched between a thin film layer bonded as a facesheet to one side and another thin film bonded as a facesheet but elongated to also form an RF cover between pairs of vertical ribs; metallization on the thin film, from a mechanical or electro-chemical process, wherein the thin film layer and the metallization layer on the top of the sandwich structure form the top cover of the stiffener/reflector; and a conductive epoxy formed on a side of the sandwich structure to electrically couple the metallization layer to the ground layer of the RF emitter. Horizontal ribs comprise of a symmetric foam-core sandwich construction with metallized thin film facesheets and are not connected by metallized film in the nature that pairs of vertical ribs are connected by their integrated outer facesheet/RF cover.

The thin film and the metallization may be bent 90 degrees at the top edge of the foam to cover the top of the sandwich structure and form the top cover of the stiffener/reflector. The stiffness and coefficient of thermal expansion of the metallization aids in matching the coefficient of thermal expansion (CTE) of the stiffener/reflector to that of the RF emitter.

In some embodiments, the present invention is an integrated stiffener and RF reflector (stiffener/reflector) for an RF emitter which includes: a plurality of vertical ribs constituting side walls of the stiffener/reflector; a plurality of horizontal ribs foamed in a width direction of the stiffener/reflector; a top cover including a thin metallized film layer, the top cover being electrically coupled to a ground layer of the RF emitter and configured in such a way to direct all of RF energy in an opposite direction to the top cover. Each of the vertical and horizontal ribs has a sandwich structure, which includes: a foam layer disposed on a layer of the RF emitter; a structurally reinforced adhesive to attach the non-metallized thin film to sides of the foam layer to form facesheets of the sandwich structure. The thin metallized layer on the top of the sandwich structure forms the top cover of the stiffener/reflector; and a conductive epoxy formed on a side of the sandwich structure to electrically couple the thin metal layer to the ground layer of the RF emitter.

In some embodiments, the structurally reinforced adhesive is a glass-filled adhesive and is configured in such a way that the net stiffener coefficient of thermal expansion matches a coefficient of thermal expansion (CTE) of the RF emitter.

BRIEF DESCRIPTION OF THE DRAWINGS

A more complete appreciation of the present invention, and many of the attendant features and aspects thereof, will become more readily apparent as the invention becomes better understood by reference to the following detailed description when considered in conjunction with the accompanying drawings in which like reference symbols indicate like components, wherein.

DETAILED DESCRIPTION

The present invention will now be described more fully with reference to the accompanying drawings, in which exemplary embodiments thereof are shown. The invention may, however, be embodied in many different forms and should not be construed as being limited to the embodiments set forth herein. Rather, these embodiments are provided so that this disclosure is thorough and complete, and will fully convey the concept of the present invention to those skilled in the art.

The present invention integrates mechanical and electrical features into one part of an RF emitter, for example, a radar panel structure and therefore increases the overall mass and depth efficiency. In some embodiments, the present system is a lightweight stiffener for flexible RF emitter and includes integrated radio frequency (RF) cavity-backed radiator. The invention provides mechanical stiffness and mounting features (mechanical feature) to a flexible RF emitter, such as, a thin film-based RF emitter. Also, the lightweight stiffener of the present invention has a minimal mass impact while simultaneously directing RF energy (electrical feature) outwards from only the front of the RF emitter (radar panel). Without the lightweight integrated stiffener and reflector cavity of the present invention, the radiating elements (excited by the TR modules) would radiate in a bi (or omni)-directional manner and consume twice (or more) the power of a unidirectional radar panel. The invention also provides a ground plane, which acts as an EMI shield for the radar electronics on the back of the panel.

Figure 1:
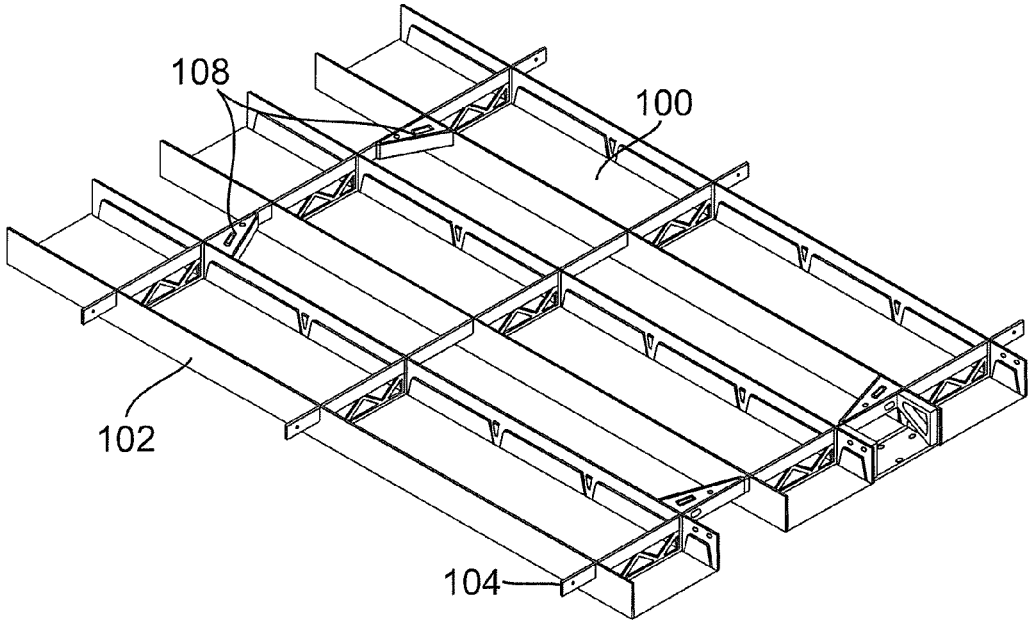
FIG. 1 is a perspective front view diagram of a stiffener with three integrated RF reflectors, according to some embodiments of the present invention.

FIG. 1 is a perspective front view diagram of the stiffener with three integrated RF reflectors, according to some embodiments of the present invention. The integrated reflectors are designed to redirect the RF energy from multiple radiating element within its cavity. In FIG. 1, each integrated reflectors redirect RF energy from three radiating elements. As shown, six vertical ribs 102 constitute each side wall of each reflector 100. There are also three horizontal ribs 104 that are disposed in the width direction of each reflector 100 and span entirely the three reflectors 100. The intersections of the horizontal ribs 104 and vertical ribs 102 are reinforced in some places by the triangular-shaped gussets 108. One with ordinary skills in the art would understand that the present invention is not limited to three reflectors, or six vertical and six horizontal rib and thus any number or shape of ribs may be used. The bottom of the reflectors 100 are metallized to reflect the radar radiation to the front of the reflectors (radar panel).

Figure 2:
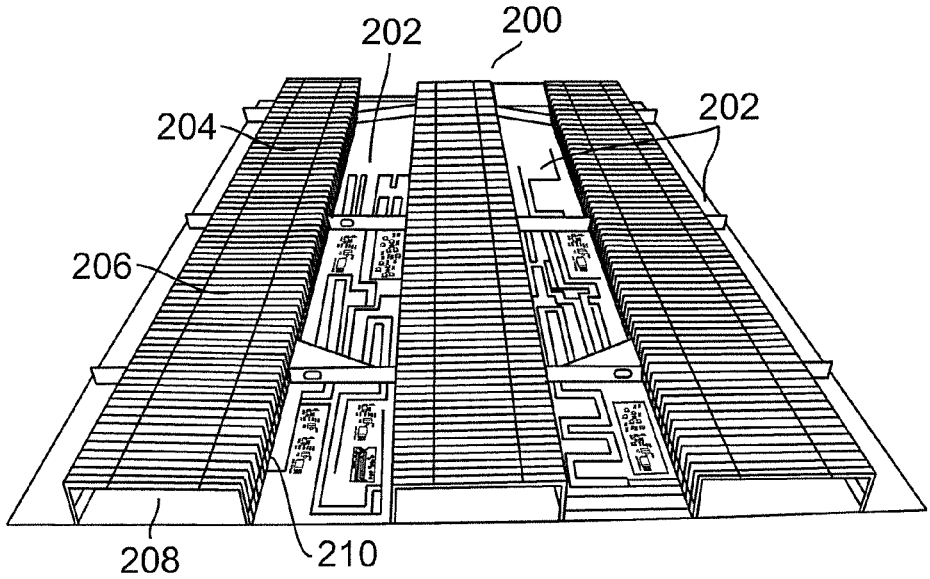
FIG. 2 is a back view diagram of a stiffener with three integrated RF reflectors, according to some embodiments of the present invention.

FIG. 2 is a bottom view diagram of the stiffener with three integrated RF reflectors, according to some embodiments of the present invention. As shown the reflectors 200 are bonded to the side walls of the vertical ribs in an integrated manner such that they form the facesheet of the vertical rib sandwich construction and then stretched between pairs of vertical ribs, opposite of the radiating elements of the RF emitter (radar panel) 202. Each reflector 200 includes a metallization layer 206, for example, copper traces that are spaced appropriately based on reflected frequency. The radiating elements, the TR modules 208 (not shown) and other electronic circuitry are enclosed inside the three reflectors 200. The ribs are spaced apart such that the metallized reflector 200 attached to pairs of vertical ribs provides an RF cavity behind the TR modules 208. The metallized layer is electrically coupled to the panel ground layer at multiple electrical connection points 210 along the length of the vertical ribs. This construction allows the cavity to reflect all of the RF energy outwards from the front of the panel. In some embodiments, the sputtered metallization along the film can be thin enough (and patterned as needed) to realize the reflector functionality without added weight. The rib height and rib placement along the panel, and hence the corresponding cavity height and width, are sized based on the wavelength of the RF energy.

In some embodiments, the horizontal ribs have metallization on the facesheets (which can be etched if desired), and this metal is electrically connected to the metal on the vertical ribs using conductive epoxy at the intersection of vertical and horizontal ribs. Therefore the metal on the horizontal ribs is connected to the ground layer via the vertical rib metallization.

Figure 3:
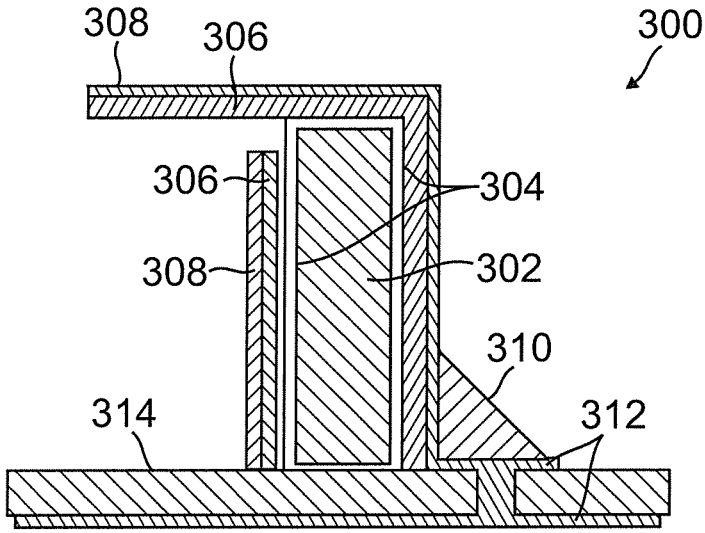
FIG. 3 is an exemplary diagram of a cross section of the structure of a stiffener vertical rib, according to some embodiments of the present invention.

FIG. 3 is an exemplary diagram of a cross section of the structure of a stiffener rib, according to some embodiments of the present invention. As shown, a foam material 302, for example, a Rohacell™ foam is positioned on a panel layer 314, constitutes the middle layer of the sandwich structure. A thin film layer, such as a liquid crystal polymer (LCP) film 306 is bonded to the sides and top of the foam layer 302 by an adhesive material 304, such as a film adhesive to form the facesheets of the sandwich structure. Thin traces of a metal 308, such as copper, are formed on the LCP film. Said metal 308 area may be reduced by a chemical etching process to further reduce weight. The LCP film and the copper layer thereon on top of the sandwich structure form the cover of the reflector (e.g., 208 in FIG. 2). A conductive epoxy 310 is disposed on one or both sides of the sandwich structure to electrically couple the metal (copper) layer 308 to a ground plane 312 of the RF emitter (radar panel).

In some embodiments, the LCP film and the copper layer thereon for the vertical ribs are bent 90 degrees at the top right edge 316 of the foam 302 to cover the top of the sandwich structure and form the cover of the reflector (e.g., 208 in FIG. 2). As shown, these embodiments use the metallized LCP film 306 as the outer facesheets of the sandwich structure of the ribs to create an RF cover. In some embodiments, the outer facesheets are laminated to form the RF cover. This process is relatively time consuming and thus relatively costly. The RF cover is electrically connected to the panel ground 312 by the conductive epoxy 310.

According to these embodiments, the LCP 306 with metallization layer is integrated into the facesheets of the sandwich rib. That is, the LCP 306 with metallization layer has dual functionality. The electrical functionality is for the RF cover to reflect the radar radiation. The mechanical (structural) functionality of the LCP 306 with metallization layer is to both carry loads as the outer face sheet of the vertical rib (e.g., 102 in FIG. 1) and for the stiffness of the metallization to keep the foam 302 core sandwich from substantial expansion/contraction due to temperature changes.

Figure 4:
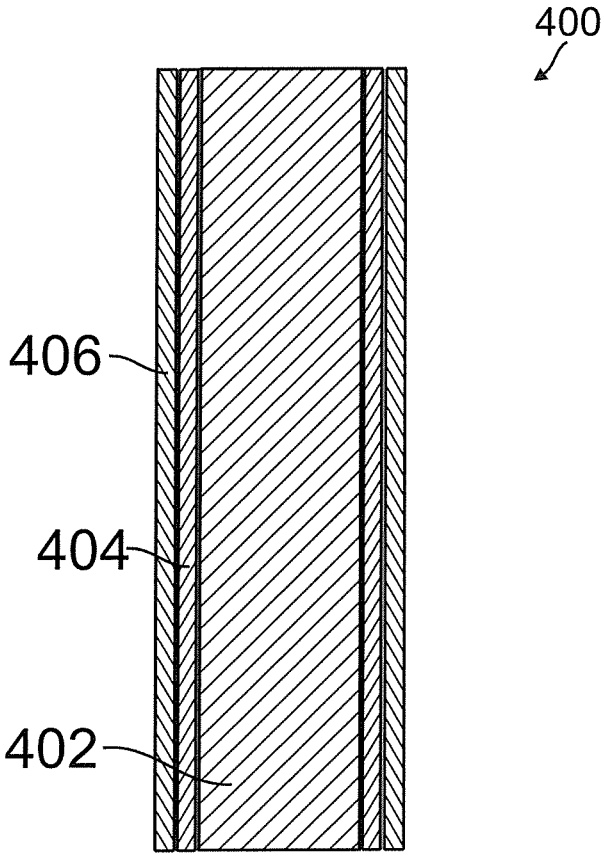
FIG. 4 is an exemplary diagram of a cross section of the structure of a stiffener rib, according to some embodiments of the present invention.

FIG. 4 is an exemplary diagram of a cross section of the structure of a stiffener rib, either vertical or horizontal, according to some embodiments of the present invention. The embodiments according to FIG. 4 differ from the embodiments depicted in FIG. 3 by being relatively heavier, but less complicated and less costly to manufacture. As shown, the stiffener rib 400 comprises of a foam layer 402, for example, a Rohacell™ foam, sandwiched between a thin film layer 406, for example a metallized Kapton layer. The film layer 406 is attached to the foam layer 402 by adhesive material 404. Here, since the film layer 406 cannot provide sufficient rigidity to keep the foam 402 sandwich from substantial expansion/contraction due to temperature changes, the adhesive material 404 is reinforced by mixing rigid material such as glass with the adhesive material to provide sufficient rigidity to match the CTE of the stiffener rib 400 to the radar panel. In these embodiments, the metallized film layer is not part of the sandwich structure rib—it is simply taped to the side of the vertical rib pairs, bent about 90 degrees and stretched between rib pairs to foam the top cover.

Figure 5:
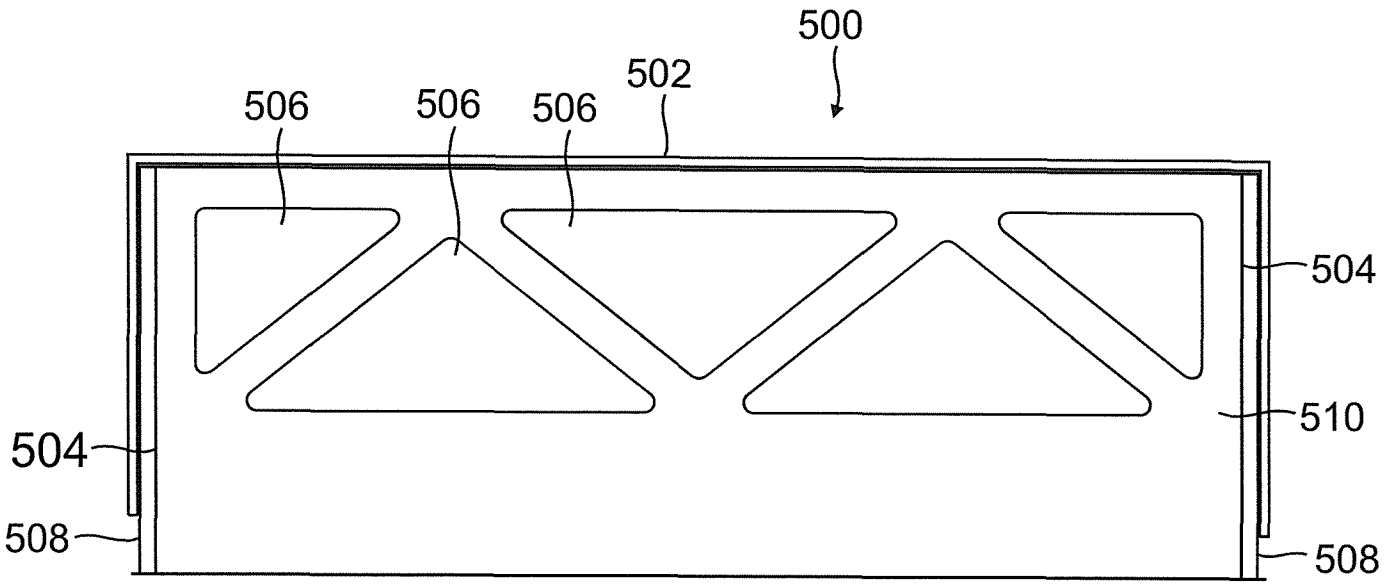
FIG. 5 is an exemplary diagram of a cross section of a radar cover, according to some embodiments of the present invention.

FIG. 5 is an exemplary diagram of a cross section of a radar cover, according to some embodiments of the present invention. A metallized layer (e.g., metallized film) 502 is stretched between adjacent ribs to form the top cover, then bent 90 degrees and taped or otherwise bonded to the two sides of the sandwich structure rib 504 (e.g., 400 from FIG. 4) with two gaps 508 at the bottom of the two sides to prevent short circuit of the metal layer to the radar panel circuitry. In this case, the horizontal rib 510 is shaped to have height to support the metallized film layer 502 along with five openings 506 in order to reduce weight, although, the shape of the horizontal rib 510 is not limited to the depicted shape and can take any shape. In some embodiments the metallized plastic layer 502 has either continuous metallization or metallization etched into a desired pattern. The metallized side of the film faces outwards as to facilitate electrical connection to the RF emitter (radar panel) ground plate using conductive epoxy 310 similar to FIG. 3. In this case, the RF cover 502 is non-structural because it is not a facesheet of the vertical ribs and thus does not carry loads. The result is a relatively heavier reflector/stiffener that is easier and less expensive to construct.

Figure 6:
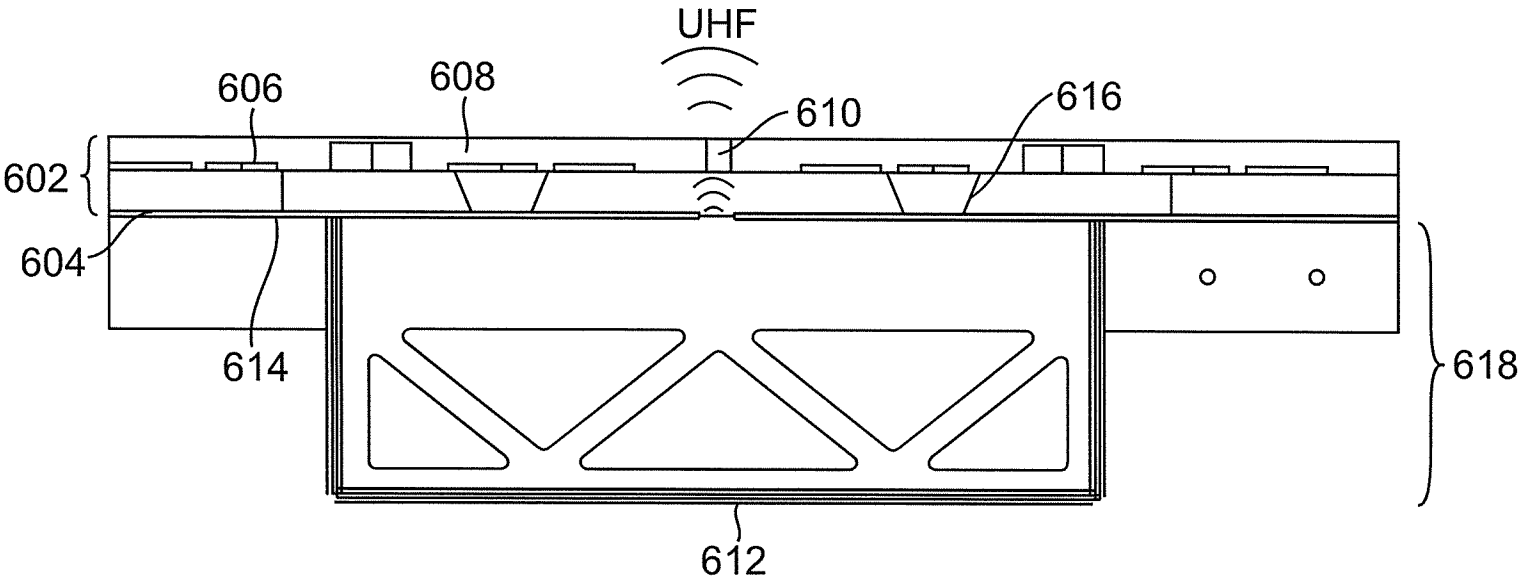
FIG. 6 is an exemplary diagram of a cross section of a flexible dual band radar panel, according to some embodiments of the present invention.

FIG. 6 is an exemplary diagram of a cross section of a flexible dual band radar panel, according to some embodiments of the present invention. As depicted, the radar panel 600 includes an X-band 602 on the top and a UHF-band 604 on the bottom of the panel. An UHF reflector cover/stiffener 618 is tied to a UHF ground layer 612 to realize an open ended shallow but wide cavity for the UHF radiator. A UHF circuit layer 614 includes a ground plane and UHF radiator slots. An opening 610 through the X-band layer 602 allows the UHF radiations out of the front side of the panel 600. The RF TR electronics and power storage capacitors 608 the digital circuitry 606 for the X-band 602 are formed appropriately, within the X-band layer. As shown, the X-band 602 includes L2 feeds 616. This radar panel 600 is able to achieve low mass while integrating antenna electrical features with its structure.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. An integrated stiffener and RF reflector (stiffener/reflector) for an RF emitter comprising:
- a plurality of vertical ribs including metallization layer forming side walls of the stiffener/reflector;
- a plurality of horizontal ribs formed in a width direction of the stiffener/reflector;
- a top cover including a metallization layer, the top cover and the side walls being electrically coupled to a ground layer of the RF emitter and configured in such a way to direct all of RF energy in an opposite direction to the top cover, wherein each of the plurality of vertical and horizontal ribs has a sandwich structure comprising:
- a foam core layer disposed on a layer of the RF emitter;
- a thin film layer bonded to sides and top of the ribs to faun facesheets of the sandwich structure;
- the metallization layer on the thin film layer, wherein the thin film layer and the metallization layer on the top of the sandwich structure form the top cover of the stiffener/reflector; and
- a conductive epoxy formed on a side of the sandwich structure to electrically couple the metallization layer to the ground layer of the RF emitter.

2. The stiffener/reflector of claim 1, wherein the plurality of vertical ribs comprises six vertical ribs.

3. The stiffener/reflector of claim 1, wherein the plurality of horizontal ribs comprises three horizontal ribs.

4. The stiffener/reflector of claim 1, wherein the plurality of vertical and horizontal ribs are connected to each other by a plurality of gussets, and wherein the metallization layer on the vertical ribs is electrically coupled to the metallization layer on the horizontal ribs by a conductive epoxy.

5. The stiffener/reflector of claim 1, wherein the bottom surfaces of the plurality of vertical and horizontal ribs are directly bonded to the back side of the RF emitter opposite of the top cover.

6. The stiffener/reflector of claim 1, wherein the metallization layer comprises of a continuous metal layer or metal traces spaced apart.

7. The stiffener/reflector of claim 1, wherein the thin film and the metallization are bent 90 degrees at the top edge of the foam of two adjacent vertical ribs to cover the top of the sandwich structure and form the top cover of the stiffener/reflector.

8. The stiffener/reflector of claim 1, wherein a combined stiffness/coefficient of thermal expansion (CTE) of the metallization layer, adhesive layer and foam core matches a coefficient of thermal expansion of the RF emitter.

9. A flexible RF emitter including the integrated stiffener and RF reflector of claim 1.

10. An integrated stiffener and RF reflector (stiffener/reflector) for an RF emitter comprising:
- a plurality of vertical ribs forming side walls of the stiffener/reflector;
- a plurality of horizontal ribs formed in a width direction of the stiffener/reflector;
- a top cover including a thin metal layer, the top cover being electrically coupled to a
- ground layer of the RF emitter and configured in such a way to direct all of RF energy in an opposite direction to the top cover, wherein each of the plurality of vertical and horizontal ribs has a sandwich structure comprising:
  - a foam layer disposed on a layer of the RF emitter;
  - a structurally reinforced adhesive to attach the thin film layer to sides of the foam layer to final facesheets of the sandwich structure;
  - a metallized thin film adhered in a non-structural manner to outer sides of two adjacent vertical ribs to form the top cover of the stiffener/reflector; and
  - a conductive epoxy formed on a side of the sandwich structure to electrically couple the metallized thin film layer to the ground layer of the RF emitter.

11. The stiffener/reflector of claim 9, wherein the structurally reinforced adhesive is a glass-filled adhesive and is configured in such a way that a stiffness/coefficient of thermal expansion (CTE) of the ribs matches a coefficient of thermal expansion (CTE) of the RF emitter.

12. The stiffener/reflector of claim 10, wherein the plurality of vertical ribs comprises six vertical ribs.

13. The stiffener/reflector of claim 10, wherein the plurality of horizontal ribs comprises three horizontal ribs.

14. The stiffener/reflector of claim 10, wherein the plurality of vertical and horizontal ribs are mechanically connected to each other by a plurality of gussets.

15. The stiffener/reflector of claim 10, wherein the bottom surfaces of the plurality of vertical and horizontal ribs are directly bonded to the back side of the RF emitter opposite of the top cover.

16. The stiffener/reflector of claim 10, wherein the top cover comprises of a metallized Kapton layer.

17. The stiffener/reflector of claim 10, wherein each of the plurality of vertical and horizontal ribs is fabricated as a symmetrical sandwich structure, in which a continuous metallized film is adhered to the outer facesheets of two adjacent ribs in a nonstructural manner to form the cover of the stiffener/reflector.

18. A flexible RF emitter including the integrated stiffener and RF reflector of claim 10.

* * * * *